US008588982B2

(12) United States Patent
Lee et al.

(10) Patent No.: US 8,588,982 B2
(45) Date of Patent: Nov. 19, 2013

(54) MECHANICAL PARKING SYSTEM FOR VEHICLES AND METHOD FOR CONTROLLING THE SAME

(75) Inventors: Hou-Hsien Lee, New Taipei (TW); Chang-Jung Lee, New Taipei (TW); Chih-Ping Lo, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 304 days.

(21) Appl. No.: 13/220,701

(22) Filed: Aug. 30, 2011

(65) Prior Publication Data

US 2012/0323369 A1 Dec. 20, 2012

(30) Foreign Application Priority Data

Jun. 14, 2011 (TW) ..... 100120673 A

(51) Int. Cl.
*G05B 13/00* (2006.01)
*G06K 9/00* (2006.01)

(52) U.S. Cl.
USPC ..... 700/275; 700/79; 700/80; 382/115; 382/153; 348/46; 348/61

(58) Field of Classification Search
None
See application file for complete search history.

(56) References Cited

U.S. PATENT DOCUMENTS

| | | | | |
|---|---|---|---|---|
| 4,490,660 | A * | 12/1984 | Tsuchihashi | 700/255 |
| 2005/0220594 | A1* | 10/2005 | Haag | 414/529 |
| 2011/0082588 | A1* | 4/2011 | McDowell et al. | 700/275 |
| 2011/0182703 | A1* | 7/2011 | Alan | 414/231 |

* cited by examiner

*Primary Examiner* — Sean Shechtman
(74) *Attorney, Agent, or Firm* — Altis & Wispro Law Group, Inc.

(57) ABSTRACT

An exemplary mechanical parking system includes platforms for parking vehicles, a switch electrically connected to the platforms, cameras mounted on the platforms, a data processing device electrically connected to the cameras and the switch, and an alarm electrically connected to the data processing device. When any one of the platforms is switched to move, the cameras capture photos/videos for an environment of the mechanical parking system and send the photos/videos to the data processing device continuously. The data processing device analyzes whether there is a person appearing in the photos/videos and decides whether the movement of the platform should be stopped via the switch. After the danger is precluded, the movement of the platform is restored and the cameras start to work again, until the parking of the car is finished.

18 Claims, 2 Drawing Sheets

MECHANICAL PARKING SYSTEM FOR VEHICLES AND METHOD FOR CONTROLLING THE SAME

BACKGROUND

1. Technical Field

The present disclosure relates to mechanical parking systems and methods for motor vehicles, and more particularly, to a mechanical parking system incorporating a device for automatically detecting humans and a method for controlling the mechanical parking system.

2. Description of Related Art

Mechanical parking systems for motor vehicles can solve the problems of limited space associated with conventional parking lots. A typical mechanical parking system includes a lifting platform, and a controlling switch electrically connected to the lifting platform. After a motor car stops on the lifting platform, the driver can operate the switch to raise the lifting platform to a predetermined level. Thereby, a space below the lifting platform is available for parking another car.

However, the typical mechanical parking system has some risks. In particular, if another person is present on or below the lifting platform when the driver is operating the switch, the person may be in danger if the driver continues to operate the switch.

What is needed, therefore, is a mechanical parking system and a method which can overcome the limitations described above.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
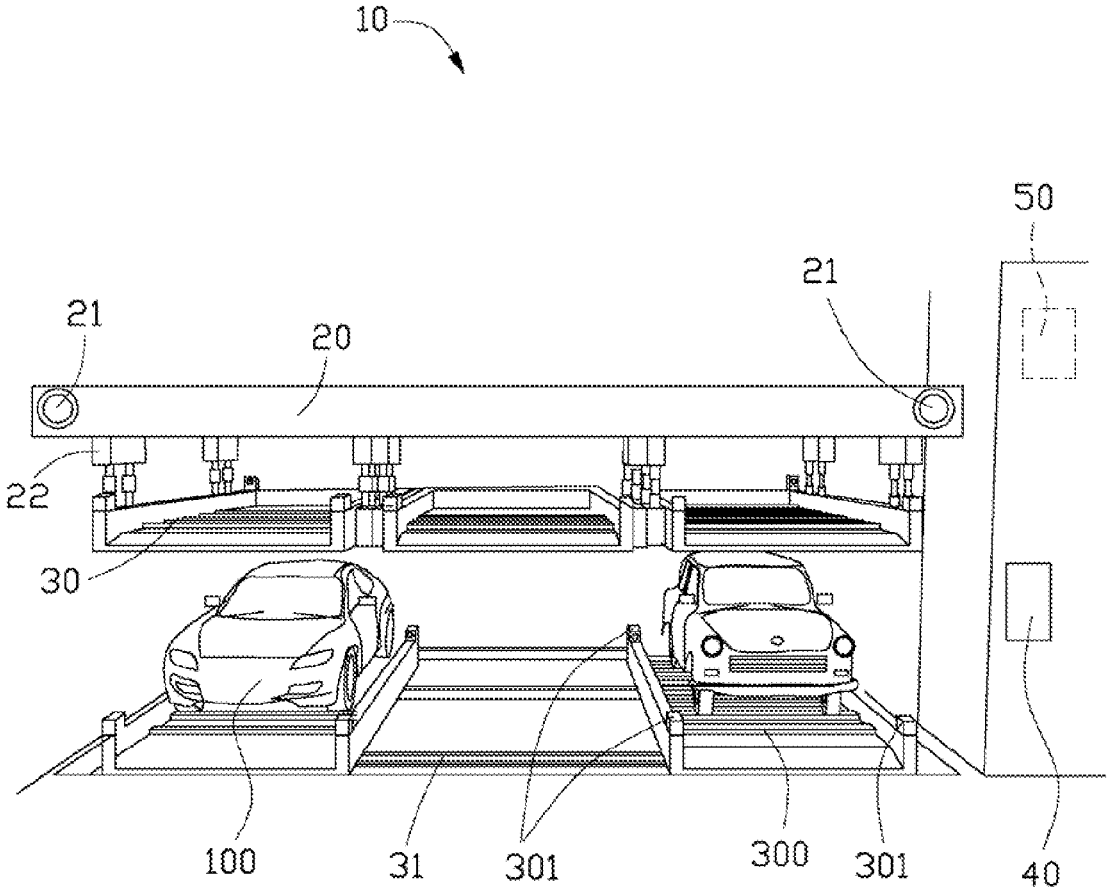
FIG. 1 is an isometric view of a mechanical parking system in accordance with an embodiment of the present disclosure.

Referring to FIG. 1, a mechanical parking system 10 in accordance with an embodiment of the present disclosure is shown. The mechanical parking system 10 includes a frame 20, a plurality of platforms 30 below the frame 20, and a controlling switch 40 electrically connected to the frame 20 and the platforms 30. Upper platforms 30 are vertical lifting platforms 30 connected to the frame 20 through arms 22, and lower platforms 30 are horizontally movable platforms 30 retained on a plurality of rails 31.

The upper platforms 30 are movable along a top-to-bottom direction by extension of the arms 22, and are movable along a bottom-to-top direction by retraction of the arms 22. In this embodiment, the arms 22 may be hydraulic retractable poles. The lower platforms 30 are movable along a left-to-right direction and along a right-to-left direction on the rails 31. Each of the upper platforms 30 can be lowered to ground level for allowing a motor car 100 to drive into or out of the upper platform 30. The lower platforms 30 can be moved laterally to avoid collision with any descending upper platform 30. However, the number of upper platforms 30 should be more than the number of lower platforms 30. Preferably, the number of upper platforms 30 is one more than that of the lower platforms 30, for leaving a free space for movement of selected of the upper platforms 30 and/or lower platforms 30.

Each platform 30 includes a rectangular base 300 for supporting the car 100 thereon. Four cameras 301 are mounted at four corners of the base 300, respectively. The four cameras 301 are electrically connected to a data processing device 50. Each camera 301 can take photographs or videos of a predetermined area of the platform 30 continuously, and send the photographs or videos to the data processing device 50. Preferably, a capturing angle of each camera 301 is larger than 120 degrees. With such wide angle capturing, not only is the platform 30 where the camera 301 is mounted monitored, but also an area adjacent to the platform 30 where the camera 301 is mounted is monitored. In particular, such wide angle capturing is more important for the lower platforms 30, since free space adjacent to the lower platforms 30 is also required to be monitored. Overall, a wider capturing angle of each camera 301 can ensure that more area is monitored.

The switch 40 is operable by a human operator to control movement of the platforms 30. The switch 40 is also electrically connected to the data processing device 50, and can be automatically controlled by the data processing device 50.

The frame 20 supports the upper platforms 30 hung over the lower platforms 30. The frame 20 has two alarms 21 mounted thereon. The two alarms 21 are electrically connected to the data processing device 50.

Figure 2:
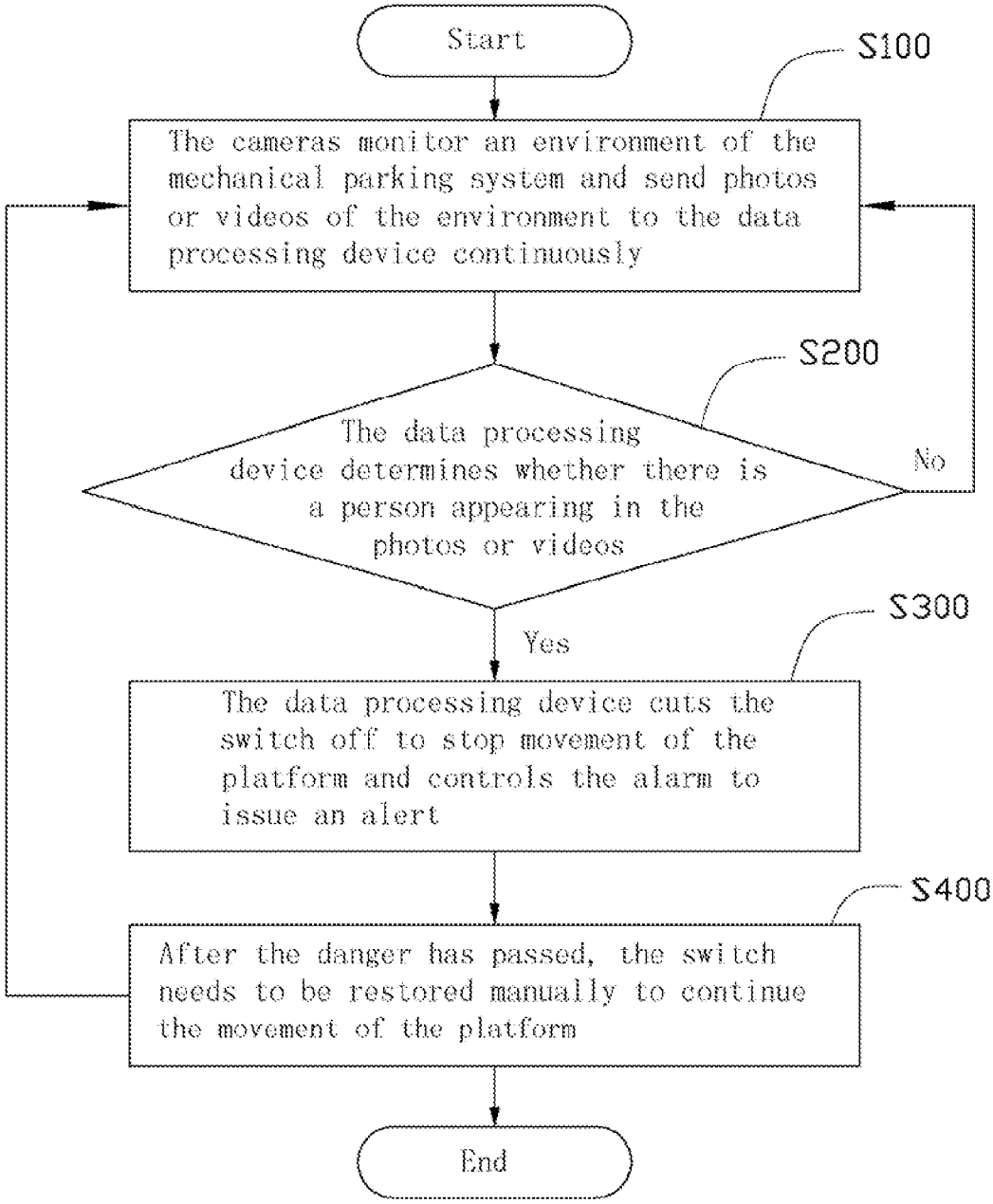
FIG. 2 is a flow diagram of operation processes of the mechanical parking system of FIG. 1.

Also referring to FIG. 2, steps S100~S400 show how the mechanical parking system 10 works. In operation of the mechanical parking system 10, in step S100, once the switch 40 is operated by an operator to raise or lower one upper platform 30, all the cameras 301 of the mechanical parking system 10 are activated to take photographs or videos of the environment of the mechanical parking system 10 continuously. The cameras 301 also send the photographs or videos to the data processing device 50 in real time. In step S200, the data processing device 50 determines whether there is a person present in the photographs or videos by using image analysis and human-detecting technology. If a person is detected, the procedure goes to step S300. In step S300, the data processing device 50 sends a signal to the controlling switch 40 to stop the movement of the platform 30 immediately. The data processing device 50 also controls the alarms 21 to sound a warning signal and flash (or flicker), to thereby warn the operator that there is a person on or below one of the platforms 30 (including any of the platforms 30 not being controlled by the operator). After the danger or potential danger has passed (e.g., by letting the person walk away from the platform 30 to a safe area), in step S400, the operator needs to operate the switch 40 again to continue the movement of the platform 30. At this time, the procedure goes to step S100 again, in which the cameras 301 are activated again by the data processing device 50 to monitor the environment of the mechanical parking system 10 until the parking of the car 100 is completed.

In this embodiment, the human-detecting technology used by the data processing device 50 may be based on a statistical method, a neural network training method, or an Ada-boost method.

The mechanical parking system 10 can effectively prevent accidents from occurring, thereby protecting people's safety within and around the mechanical parking system 10.

In various embodiments, the mechanical parking system 10 can be adapted for parking different kinds of vehicles besides motor cars 100; for example, buses, trucks, or motorcycles.

It is believed that the present embodiments will be understood from the foregoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. A mechanical parking system comprising:

a movable platform for parking a vehicle thereon;

a switch electrically connected to the platform for controlling movement of the platform;

a camera for monitoring an environment of the mechanical parking system; and a data processing device electrically connecting the camera and the switch, the data processing device configured for receiving monitoring data from the camera and controlling the switch to thereby control moving of the platform according to the monitoring data received;

wherein the camera is configured for taking images selected from the group consisting of photos and videos of the environment when the platform is moving, and the data processing device is configured for determining whether there is a person present in any of the images; and if there is no person present in any of the images, the platform keeps moving until the platform reaches a predetermined position.

2. The mechanical parking system of claim 1, wherein, if there is a person present in an image, the data processing device controls the switch to stop movement of the platform.

3. The mechanical parking system of claim 2, wherein the camera is mounted on the platform.

4. The mechanical parking system of claim 3, further comprising another three cameras, wherein each corner of the platform has one of the cameras mounted thereon.

5. The mechanical parking system of claim 4, wherein each camera has a capturing angle equal to or larger than 120 degrees.

6. The mechanical parking system of claim 1, wherein the platform is a lifting platform.

7. The mechanical parking system of claim 6, wherein when the platform is lifted, a free space is left below the platform for lowering of the platform.

8. The mechanical parking system of claim 1, wherein the platform is a horizontally movable platform.

9. The mechanical parking system of claim 2, further comprising a frame, wherein the platform is hung from the frame by a plurality of arms.

10. The mechanical parking system of claim 9, wherein the frame has an alarm mounted thereon, the alarm being electrically connected to the data processing device.

11. The mechanical parking system of claim 10, wherein the data processing device is further configured to activate the alarm to issue an alert when the data processing device stops the movement of the platform.

12. A method for controlling movement of a platform of a mechanical parking system, the method comprising:

monitoring an environment of the mechanical parking system by taking images selected from the group consisting of photos and videos;

determining whether there is a person in or near the mechanical parking system by performing image analysis of the images; and controlling movement of the platform to continue the movement or stop the movement according to the analysis result wherein the action of monitoring the environment is implemented by a camera, the action of analyzing the images is implemented by a data processing device, and the action of controlling movement of the platform is implemented by the data processing device through a switch; and wherein when the data processing device detects no person in the images when the platform is moving, the data processing device does not send any signal to the switch and the platform keeps moving until reaching the predetermined position.

13. The method of claim 12, wherein when the data processing device detects that a person is in or near the mechanical parking system and stops the movement of platform, the person is required to leave an capturing area of the camera before the movement of the platform can be continued.

14. The method of claim 12, wherein the switch is required to be manipulated by a human operator to continue the movement of the platform after the platform is stopped by the data processing device.

15. The method of claim 12, wherein an alarm is electrically connected to the data processing device.

16. The method of claim 15, further comprising the data processing device activating the alarm to issue an alert when the data processing device stops the movement of the platform.

17. The method of claim 12, wherein the platform is movable along vertical directions.

18. The method of claim 12, wherein the platform is movable along horizontal directions.

* * * * *